US010959468B2

(12) United States Patent
Sasano

(10) Patent No.: US 10,959,468 B2
(45) Date of Patent: Mar. 30, 2021

(54) VEST ASSEMBLY

(71) Applicant: Kensui LLC, Sheridan, WY (US)

(72) Inventor: Remy Sasano, Osaka (JP)

(73) Assignee: Kensui LLC, Sheridan, WY (US)

( * ) Notice: Subject to any disclaimer, the term of this patent is extended or adjusted under 35 U.S.C. 154(b) by 0 days.

(21) Appl. No.: 16/865,270

(22) Filed: May 1, 2020

(65) Prior Publication Data

US 2020/0345084 A1 Nov. 5, 2020

Related U.S. Application Data

(60) Provisional application No. 62/841,285, filed on May 1, 2019.

(51) Int. Cl.

| | |
|---|---|
| ***A41D 1/04*** | (2006.01) |
| ***A41D 13/00*** | (2006.01) |
| ***A63B 21/00*** | (2006.01) |
| ***A63B 21/065*** | (2006.01) |

(52) U.S. Cl.

CPC ..... *A41D 1/04* (2013.01); *A41D 13/0015* (2013.01); *A63B 21/00065* (2013.01); *A63B 21/065* (2013.01)

(58) Field of Classification Search

CPC .... A41D 1/04; A41D 13/0015; F41H 5/0478; F41H 5/0492; A63B 21/065; A63B 21/4007; A63B 21/4009; A63B 23/0405

USPC ..... 2/102; 482/105

See application file for complete search history.

(56) References Cited

U.S. PATENT DOCUMENTS

| | | | | |
|---|---|---|---|---|
| 2,990,089 | A * | 6/1961 | Nystrom | A45F 5/00 224/628 |
| 3,114,486 | A * | 12/1963 | Flexman | A45F 3/08 224/628 |
| 4,676,502 | A * | 6/1987 | Mahr | A63B 21/065 482/105 |
| 4,948,122 | A * | 8/1990 | Andrews, Sr. | A63B 21/065 482/105 |
| 5,167,600 | A * | 12/1992 | Baird | A63B 21/065 482/100 |
| 7,081,071 | B2 * | 7/2006 | Smith | A63B 21/065 482/105 |
| 7,326,154 | B2 * | 2/2008 | Foley | A63B 21/06 206/315.1 |
| 8,869,316 | B2 * | 10/2014 | Lewis | F41H 1/02 2/463 |
| 9,186,538 | B1 * | 11/2015 | Seen | A63B 21/072 |
| D797,868 | S * | 9/2017 | Thomas | D21/683 |
| 2018/0056107 | A1 * | 3/2018 | Clarke | A63B 21/4007 |
| 2018/0093124 | A1 * | 4/2018 | Roybal | A63B 21/0004 |
| 2018/0128577 | A1 * | 5/2018 | Beck | F41H 5/0478 |
| 2018/0283827 | A1 * | 10/2018 | 't Hart | F41H 1/02 |

* cited by examiner

*Primary Examiner* — Anne M Kozak
(74) *Attorney, Agent, or Firm* — Michael D. Eisenberg

(57) ABSTRACT

The present invention provides a vest assembly, for wearing around a body of a user performing physical activity. The vest assembly includes a front plate and a rear plate each having a perimeter that includes a plurality of slits. The slits allow for insertion of a plurality of straps. A slit of the front plate tensions one of the straps together with a corresponding slit of the rear plate to fit the vest assembly around the body of the user.

21 Claims, 16 Drawing Sheets

VEST ASSEMBLY

CROSS-REFERENCES TO RELATED APPLICATIONS

This application claims priority from U.S. Provisional Application Ser. No. 62/841,285 filed May 1, 2019, which is hereby incorporated herein by reference in its entirety.

TECHNICAL FIELD

The present invention relates to workout tools and accessories and more particularly, a vest assembly for wearing to enhance a user's workout.

BACKGROUND OF THE INVENTION

Weighted vests are commonly worn during physical activity, to increase physical strength of a user. However, current models of such vests include sand, iron blocks, or weights that need to be added or inserted into the vest. Such designs are often not portable, as they require multiple weights that work only with the specific vest to be transported in order to achieve the desired amount of weight during use. This is cumbersome and results in much time being spent during assembly and disassembly.

BRIEF SUMMARY OF THE EMBODIMENTS OF THE INVENTION

The present invention provides a vest assembly, for wearing around a body of a user performing physical activity. Unique to this invention are a front plate and a rear plate each having a perimeter that includes a plurality of slits. The slits allow for insertion of a plurality of straps. A slit of the front plate tensions one of the straps together with a corresponding slit of the rear plate to fit the vest assembly around the body of the user.

Various objects, features, aspects, and advantages of the present invention will become more apparent from the following detailed description of preferred embodiments of the invention, along with the accompanying drawings in which like numerals represent like components.

BRIEF DESCRIPTION OF THE FIGURES

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
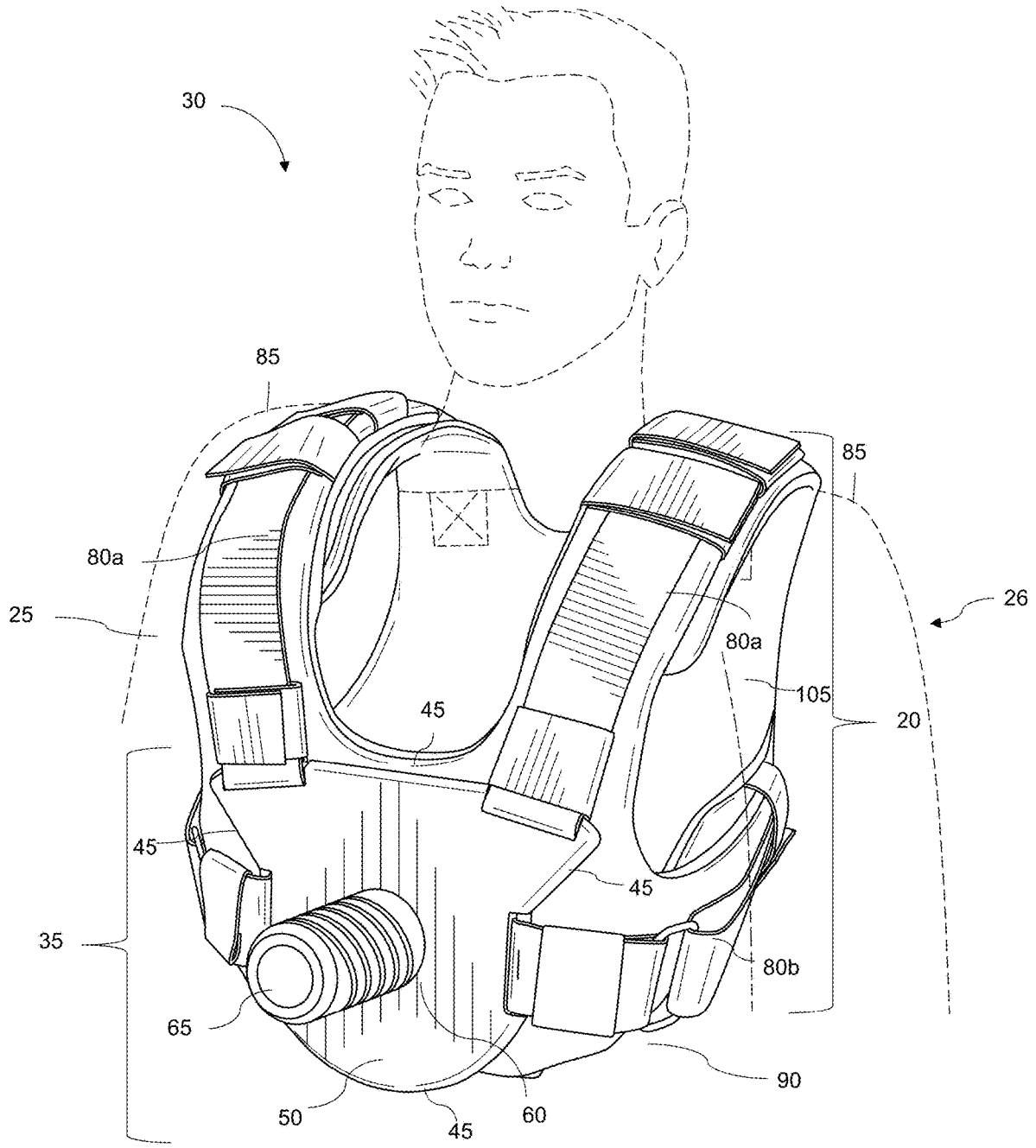
FIG. 1 is a front perspective view of a vest assembly worn around a body of a user, according to an exemplary embodiment.
Figure 2A:
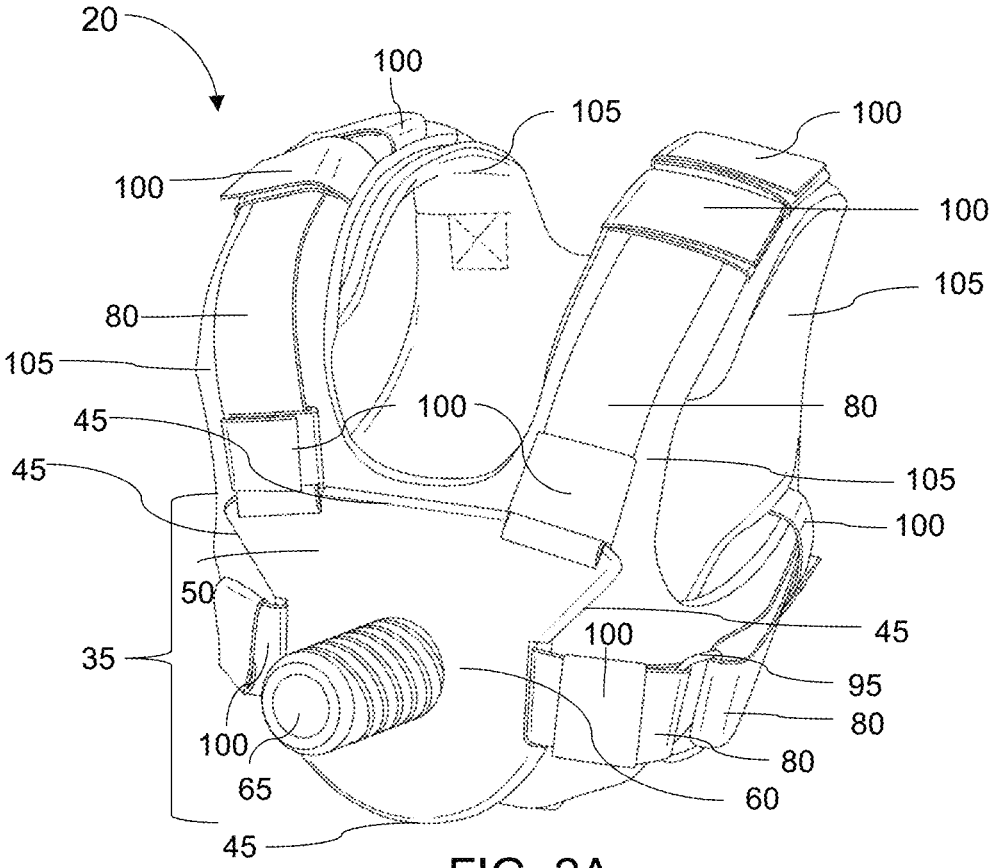
FIG. 2A is a front perspective view of a vest assembly, according to an exemplary embodiment.
Figure 3A:
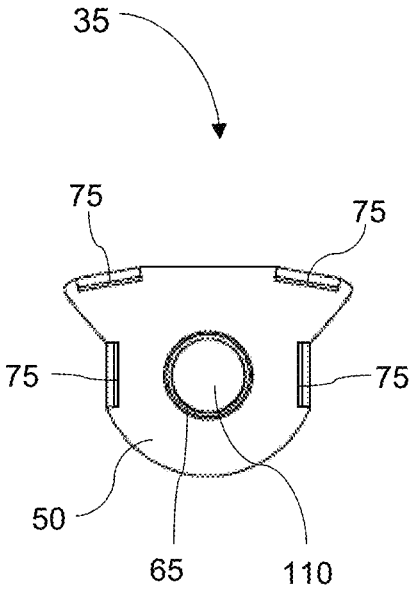
FIG. 3A is a front view of a front plate of a vest assembly, according to an exemplary embodiment.
Figure 3B:
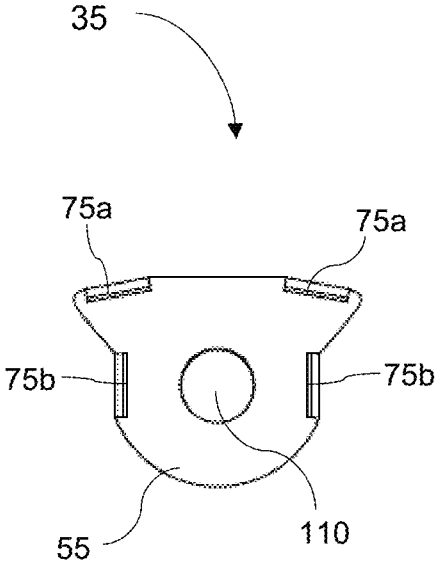
FIG. 3B is a rear view of a front plate of a vest assembly, according to an exemplary embodiment.
Figure 4A:
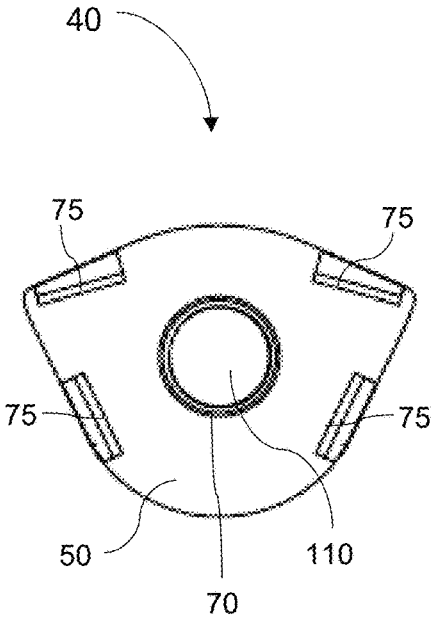
FIG. 4A is a front view of a rear plate of a vest assembly, according to an exemplary embodiment.
Figure 4B:
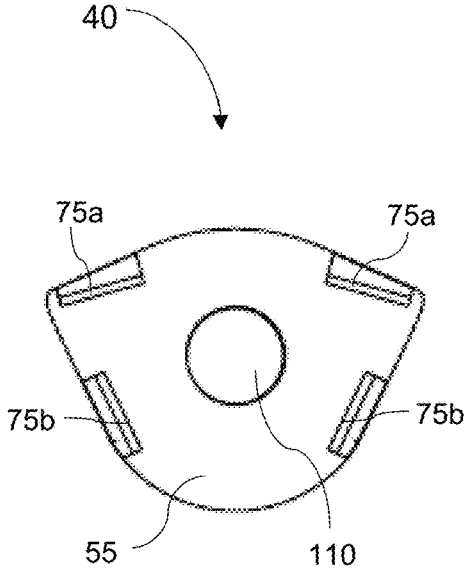
FIG. 4B is a rear view of a rear plate of a vest assembly, according to an exemplary embodiment.

First illustrated in FIG. 1, a vest assembly 20 is provided for wearing around a body 25 of a user 30 while performing physical activity. The vest assembly 20 includes a front plate 35 and a rear plate 40. The front plate 35 and the rear plate 40 each has a perimeter 45 (FIGS. 1 and 2A), a front face 50 (FIGS. 3A and 4A), a rear face 55 (FIGS. 3B and 4B), and a central area 60 (FIGS. 1 and 2A). In one instance, the front plate 35 and the rear plate 40 are of a same size and shape. In another instance, illustrated between FIGS. 3A-4B, the front plate 35 and the rear plate 40 are of differing sizes and shapes. In a further instance, both the front plate 35 and the rear plate 40 have a flat, planar surface. In yet another instance, both the front plate 35 and the rear plate 40 have a curvature to conform to the body 25 of the user 30. The front plate 35 and the rear plate 40 are, for non-limiting example, standard weight plates or Olympic weight plates.

Figure 2B:
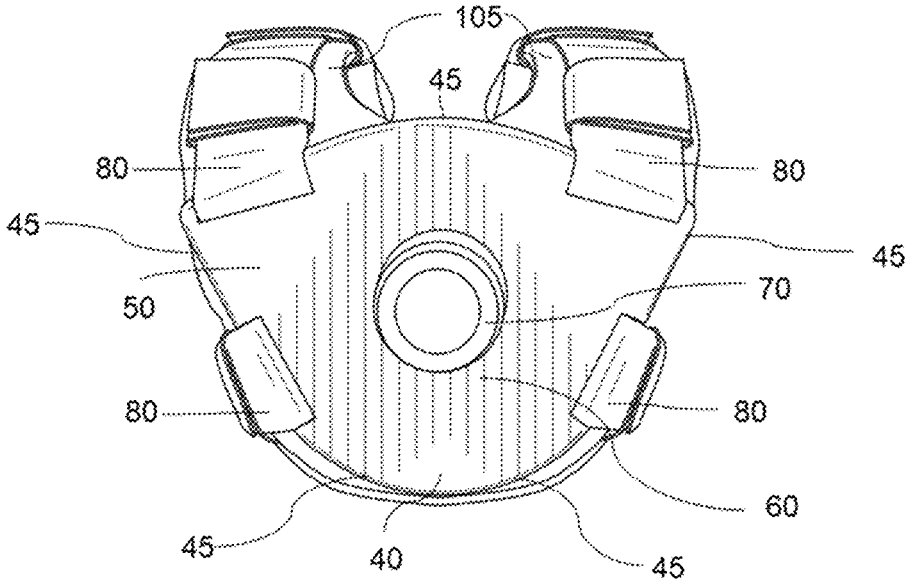
FIG. 2B is a rear view of a vest assembly, according to an exemplary embodiment.
Figure 2C:
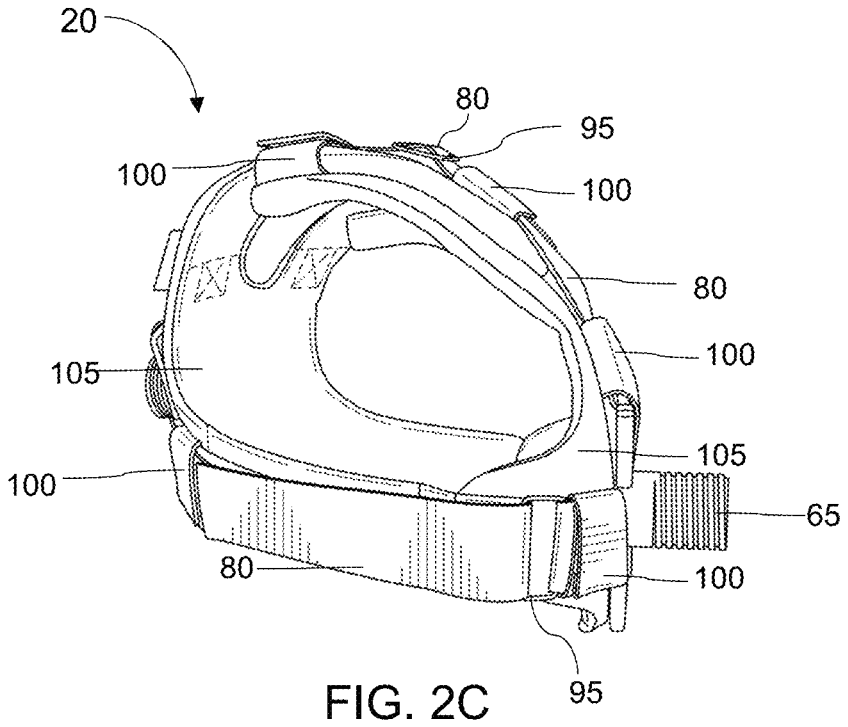
FIG. 2C is a rear perspective view of a vest assembly, according to an exemplary embodiment.

Further detailed in FIG. 2A, a first bolt 65 attaches to the central area 60 of the front plate 35, and extends outward from the front face 50 of the front plate 35. Likewise, detailed in FIG. 2B, a second bolt 70 attaches to the central area 60 of the rear plate 40, and likewise extends outward from the front face 50 of the rear plate 40. In one instance, the first bolt 65 is of a same size (e.g. diameter and length) as the second bolt 70. The first bolt 65 and the second bolt 70 are sized to accommodate different standard sizes of holes in various weights commonly found in gyms. In another instance, the first bolt 65 is of a different size from the second bolt 70. For example, the diameter of each bolt 65, 70 ranges from 25 mm to 52 mm, or from 30 mm to 50 mm.

The rear face 55 of the front plate 35 faces a front side 26 (FIG. 1) of the body 25 of the user 30, while the rear face 55 of the rear plate 40 faces a rear side (not shown) of the body 25 of the user 30.

Figure 5A:
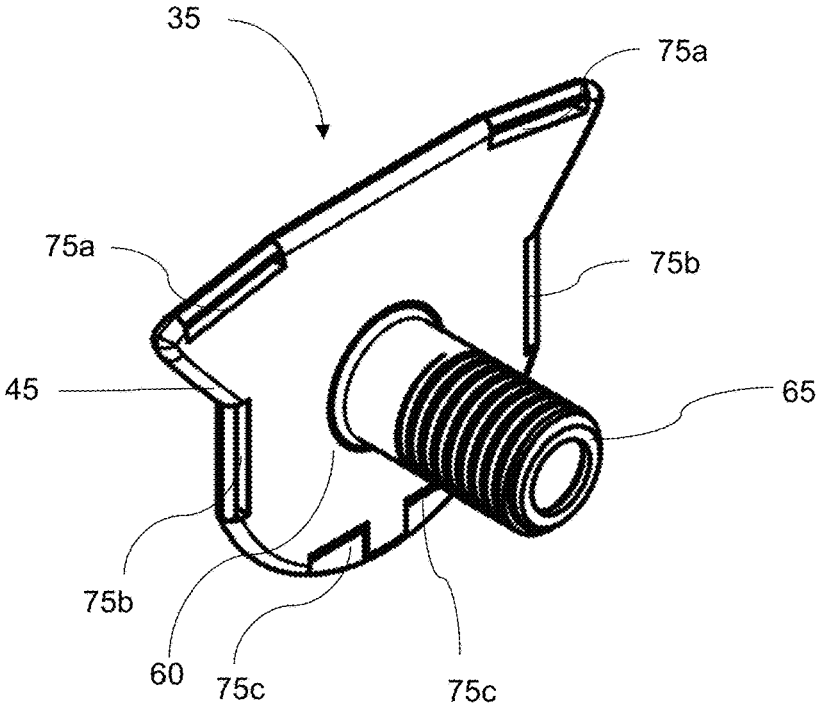
FIG. 5A is a front perspective view of a front plate and a first bolt of a vest assembly, according to an exemplary embodiment.
Figure 5B:
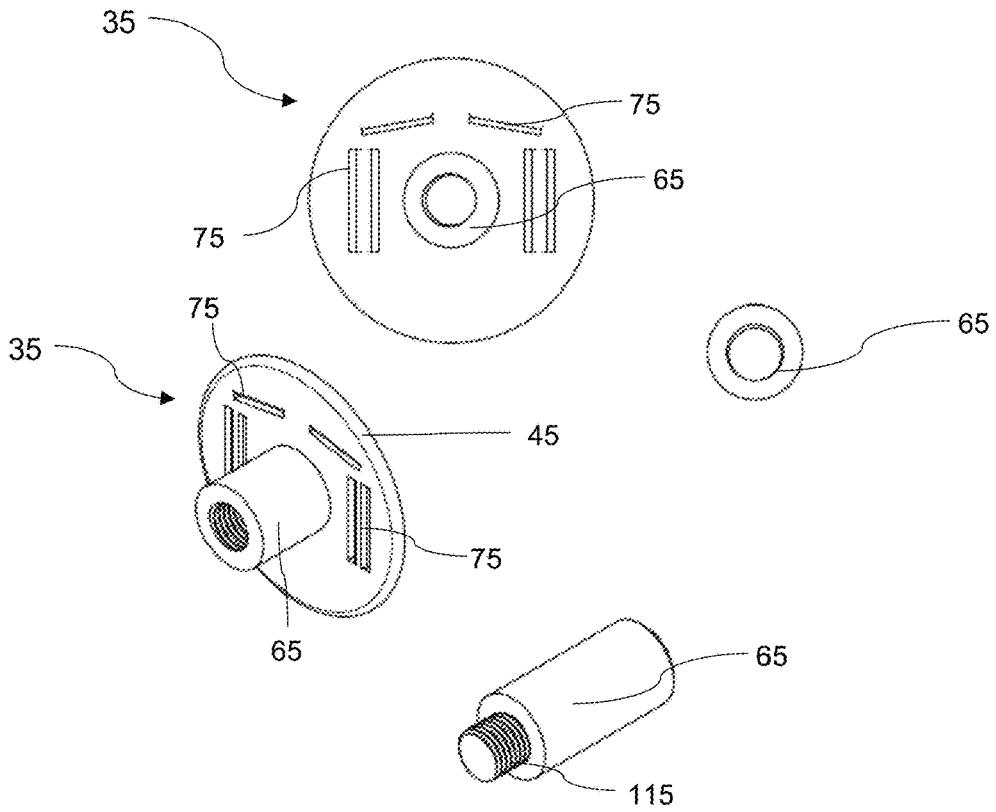
FIG. 5B is a front/front perspective view of a front plate and a first bolt of a vest assembly, according to an exemplary embodiment.
Figure 5C:
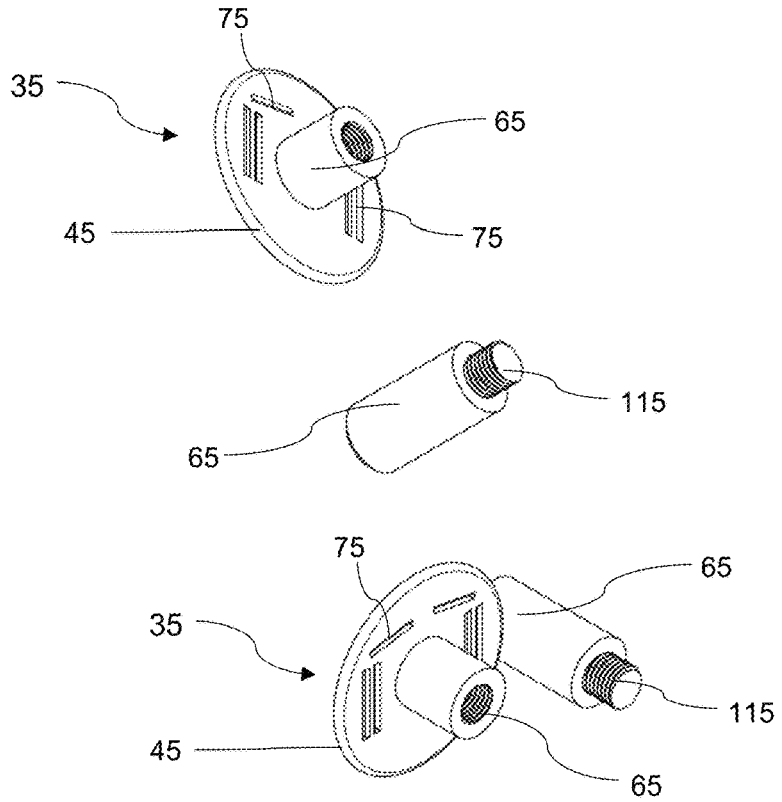
FIG. 5C is a front/front perspective view of a front plate and a first bolt of a vest assembly, according to an exemplary embodiment.
Figure 5D:
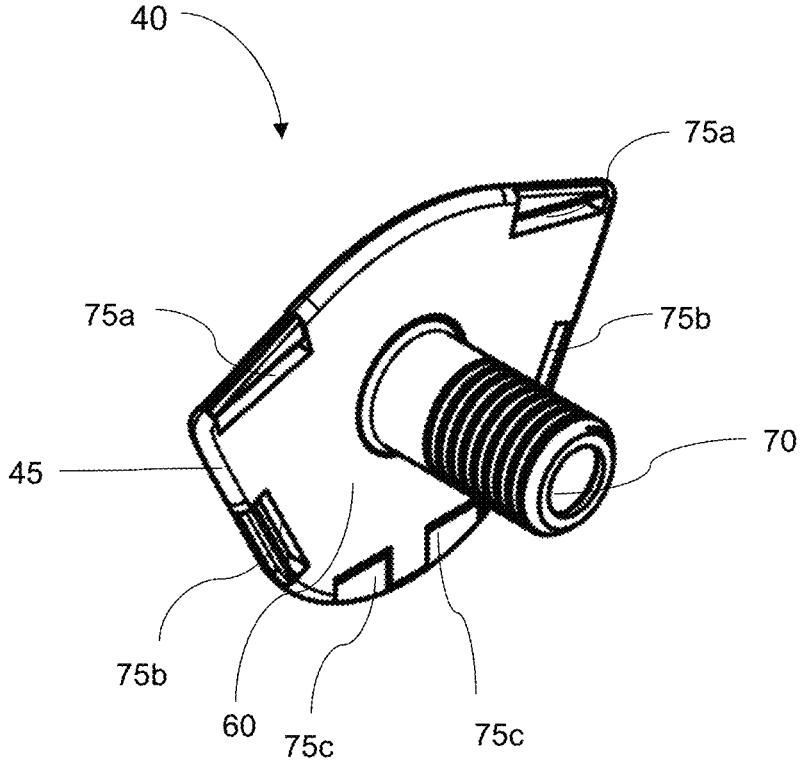
FIG. 5D is a front perspective view of a rear plate and a second bolt of a vest assembly, according to an exemplary embodiment.

As illustrated in FIGS. 3A-4B and further in FIGS. 5A-5C, the perimeter 45 of the front plate 35 includes a plurality of slits 75. Likewise, detailed in FIG. 5D, the perimeter 45 of the rear plate 40 includes a corresponding plurality of slits 75. For instance, detailed in FIGS. 3B and 4B, each perimeter 45 includes four slits 75, with two top slits 75*a*, which are horizontally oriented, or near-horizontally oriented, and two side slits 75*b* which are vertically oriented, or near-vertically oriented, and are thus oriented nearly 90° relative to each other, although the angle varies by 5° to 10°.

As FIGS. 1 and 2A-2C further illustrate, a plurality of straps 80 inserts into the slits 75 of the front plate 35 and the corresponding slits 75 of the rear plate 40. The straps 80 may be formed, for instance, of webbing comprising nylon or other suitable material. The attachment to a slit 75 of the front plate 35 tensions one of the straps 80 together with a corresponding attachment to a slit 75 of the rear plate 40 to fit the vest assembly 20 around the body 25 of the user 30. By way of example, detailed in FIG. 1, the plurality of straps 80 includes an upper pair of straps 80*a* and a lower pair of straps 80*b*. Each upper strap 80*a* is tensioned around a respective shoulder 85 of the body 25 of the user 30. Each lower strap 80*b* is tensioned around or next to a torso or a waist 90 of the body 25 of the user 30. In one instance, detailed in FIG. 2A, the straps 80 are looped via a plurality of rings 95 (e.g., D-rings or rectangle-shaped). A plurality of tri-glide fasteners 100 allows for the straps 80 to be adjusted along their respective lengths. For example, the length of an upper strap 80*a* is adjusted via a tri-glide fastener 100 to properly tension against a shoulder 85. Since the top slits 75*a* are mostly horizontally oriented, the upper pair of straps 80*a* are also horizontally oriented for a more comfortable fit around the shoulders 85 of the user 30. Since the side slits 75*b* are mostly vertically oriented, the lower pair of straps 80*b* are also vertically oriented and fit comfortably around the torso or the waist 90 of the user 30.

In another embodiment, also detailed in FIGS. 1 and 2A-2C, a plurality of pads 105 is attached to the plurality of straps 80. The pads 105 make the vest assembly 20 more comfortable to wear. By way of example, each pad 105 is attached to a corresponding one of the straps 80. In one instance, the pads 105 are attached to the straps 80 via a surface of Velcro®. In such an instance, the rings 95 slide over the surface of Velcro® to adjust a length of a strap 80. Other non-limiting examples of mechanisms for adjusting the lengths of the straps 80 include standard buckles and cam buckles. In a specific embodiment, best depicted in FIG. 2C, the pads 105 are contiguous with each other.

Figure 6:
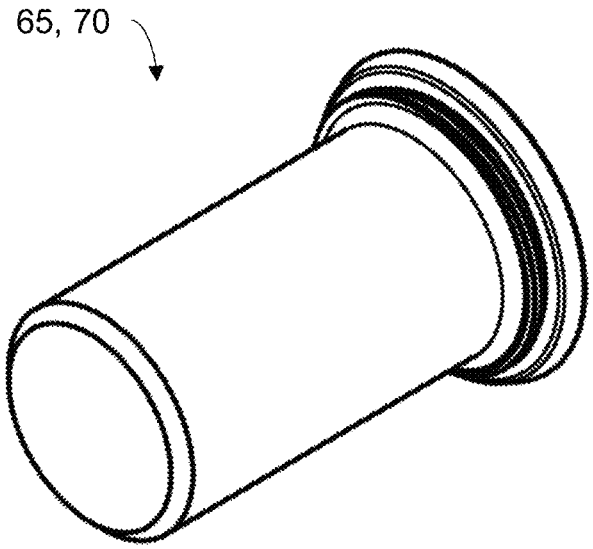
FIG. 6 is a perspective view of a bolt of a vest assembly, according to an exemplary embodiment.

In a further embodiment, the first bolt 65 and the second bolt 70 are fixed respectively to the front plate 35 and the rear plate 40. Such a bolt 65, 70 is depicted in FIG. 6.

Figure 7:
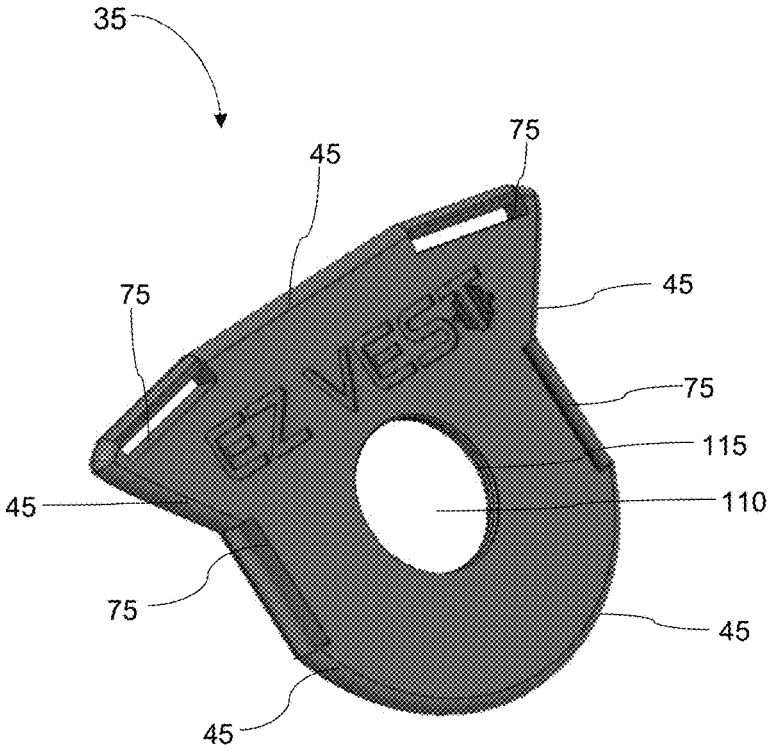
FIG. 7 is a front perspective view of a front plate of a vest assembly, according to an exemplary embodiment.
Figure 8A:
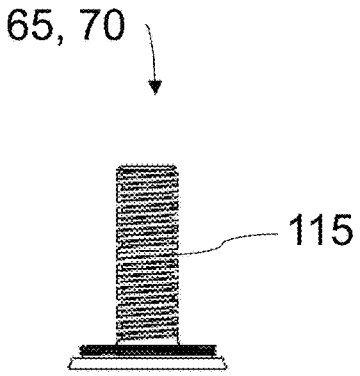
FIG. 8A is a side view of a bolt of a vest assembly, according to an exemplary embodiment.
Figure 8B:
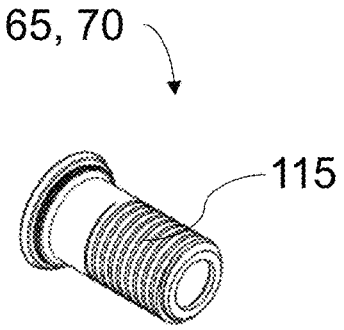
FIG. 8B is a perspective view of a bolt of a vest assembly, according to an exemplary embodiment.
Figure 8C:
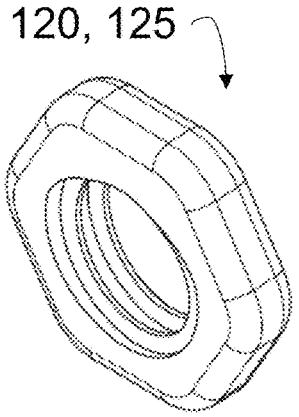
FIG. 8C is a perspective view of a fastener of a vest assembly, according to an exemplary embodiment.
Figure 8D:
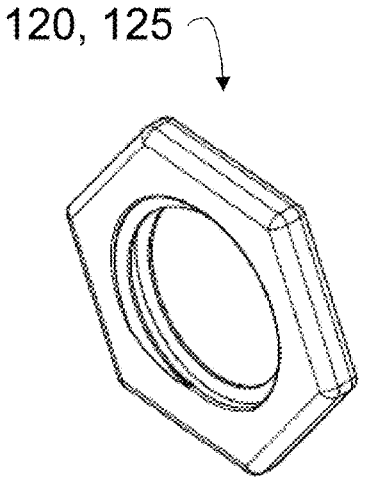
FIG. 8D is a perspective view of a fastener of a vest assembly, according to an exemplary embodiment.
Figure 8E:
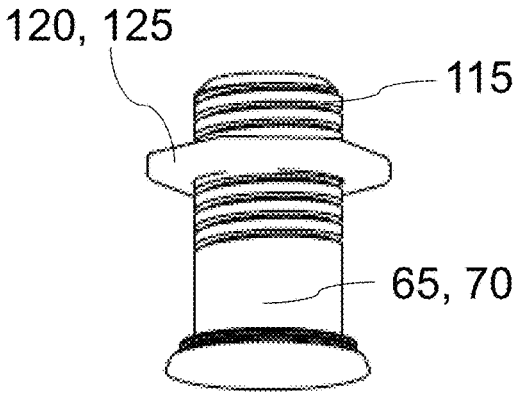
FIG. 8E is a side view of a bolt and a fastener of a vest assembly, according to an exemplary embodiment.
Figure 9A:
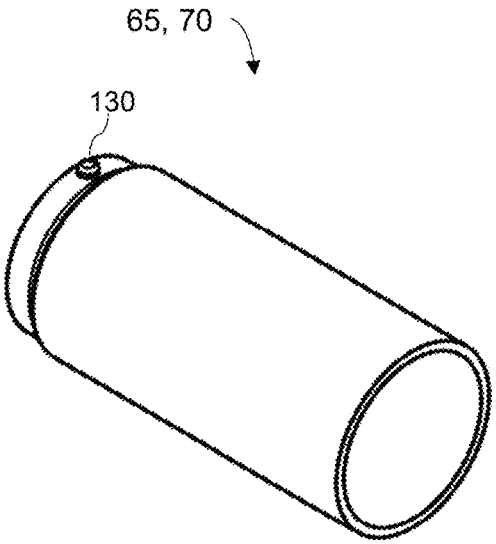
FIG. 9A is a side perspective view of a bolt of a vest assembly, according to an exemplary embodiment.
Figure 9B:
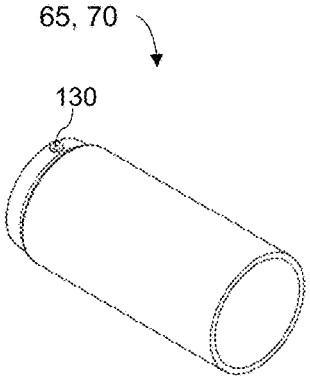
FIG. 9B is a perspective view of a bolt of a vest assembly, according to an exemplary embodiment.
Figure 9C:
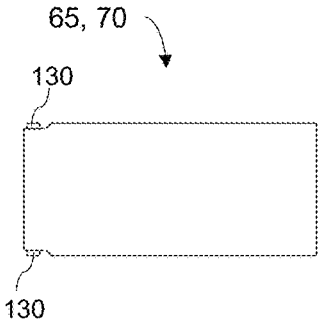
FIG. 9C is a side view of a bolt of a vest assembly, according to an exemplary embodiment.
Figure 10A:
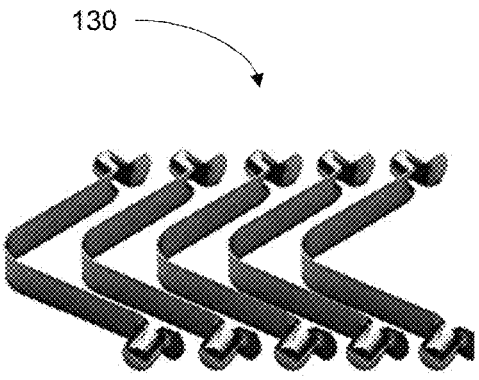
FIG. 10A is a perspective view of push pins of a vest assembly, according to an exemplary embodiment.
Figure 10B:
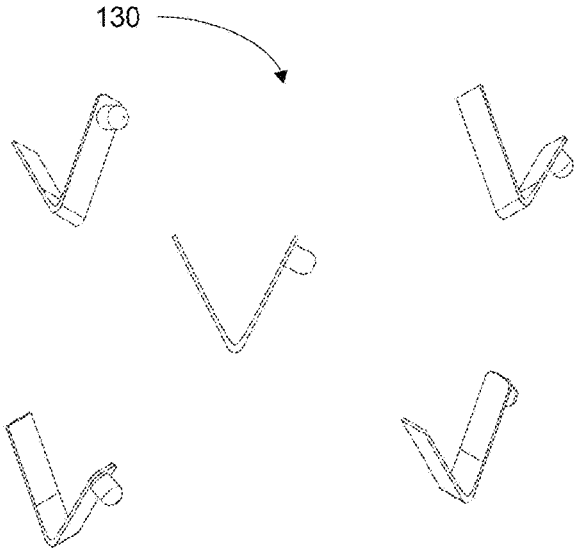
FIG. 10B is a perspective view of push pins of a vest assembly, according to an exemplary embodiment.
Figure 11A:
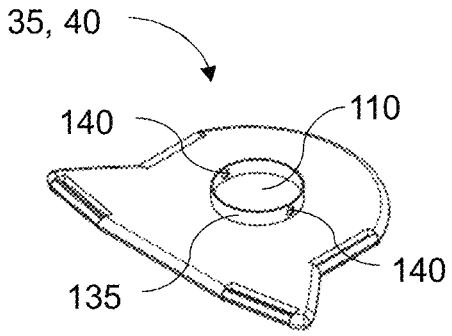
FIG. 11A is a front perspective view of a plate of a vest assembly, according to an exemplary embodiment.
Figure 11B:
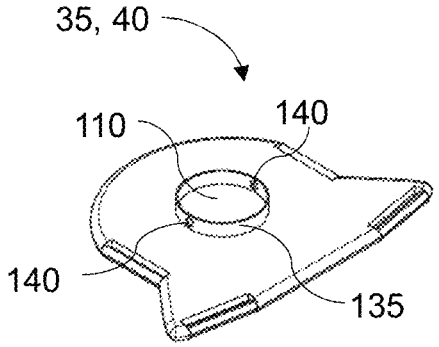
FIG. 11B is a front perspective view of a plate of a vest assembly, according to an exemplary embodiment.
Figure 11C:
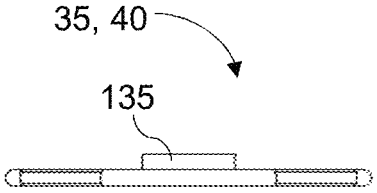
FIG. 11C is a top view of a plate of a vest assembly, according to an exemplary embodiment.

In yet another embodiment, the first bolt 65 is removable from the front plate 35, and the second bolt 70 is removable from the rear plate 40. The front plate 35 and the rear plate 40 each has a central hole 110, illustrated in FIG. 7, for instance. The first bolt 65 inserts into and removes from the central hole 110 of the front plate 35, and the second bolt 70 inserts likewise into and removes from the central hole 110 of the rear plate 40. Such an embodiment allows for easy portability and assembly/disassembly of the vest assembly 20. In one instance, depicted in FIGS. 8A and 8B, each bolt 65, 70 includes a plurality of threads 115 that mate with a corresponding plurality of threads 115 of the respective central holes 110 (FIG. 7) of each plate 35, 40. As depicted in FIGS. 8C-8E, a first fastener 120 (e.g., a nut, a spin-lock collar, or a clip-and-lockjaw clamp) secures the first bolt 65, while a second fastener 125 (e.g., a nut having a corresponding plurality of threads, a spin-lock collar, or a clip-and-lockjaw clamp) secures the second bolt 70. In another instance, detailed in FIGS. 9A-9C and 10A, each bolt 65, 70 includes a pair of push pins 130. Alternatively, as in FIG. 10B, a single push pin 130 may be used. As detailed in FIGS. 11A-11C, the respective central holes 110 of each plate 35, 40 include a circumference 135 that has a corresponding pair of indentations or slots 140 to receive the pair of push pins 130. Optionally, either or both bolts 65, 70 is smooth for use with a clamp.

Figure 12A:
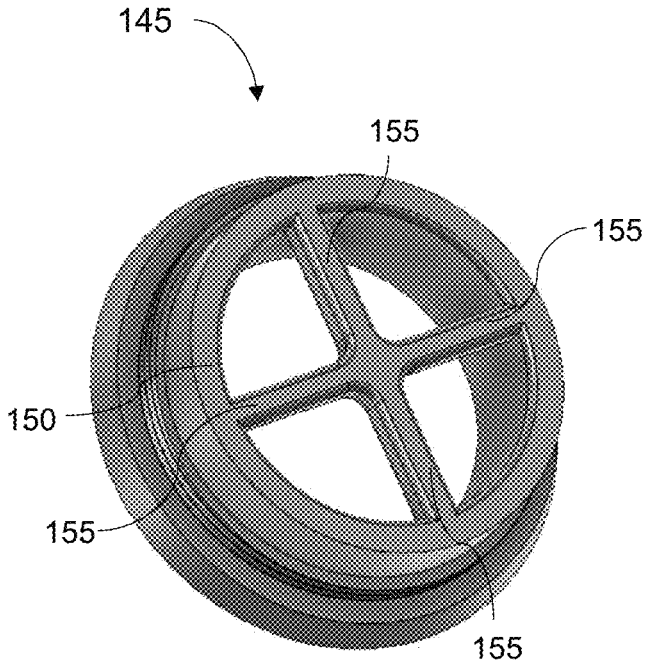
FIG. 12A is a front perspective view of an attachment of a vest assembly, according to an exemplary embodiment.
Figure 12B:
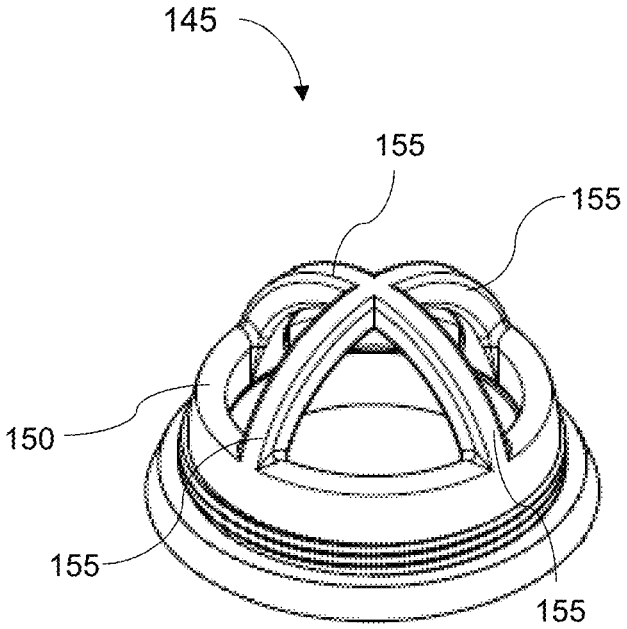
FIG. 12B is a side perspective view of an attachment of a vest assembly, according to an exemplary embodiment.

In yet a further embodiment, the vest assembly 20 further includes an attachment 145, illustrated in FIGS. 12A and 12B, that secures to the first bolt 65. The attachment 145 includes a face 150 that has a plurality of partitions 155 for attaching to a piece of equipment, such as chain weights or resistance bands. As an example, depicted in FIGS. 12A and 12B, the face 150 of the attachment 145 includes four equally-sized partitions 155. As illustrated in FIG. 12A, the face 150 is flat in one instance. In another instance, detailed in FIG. 12B, the face 150 is of a shape of a hemisphere. Non-limiting examples of mechanisms for connecting the equipment to the attachment 145 include a hook and a carabiner.

Figure 13:
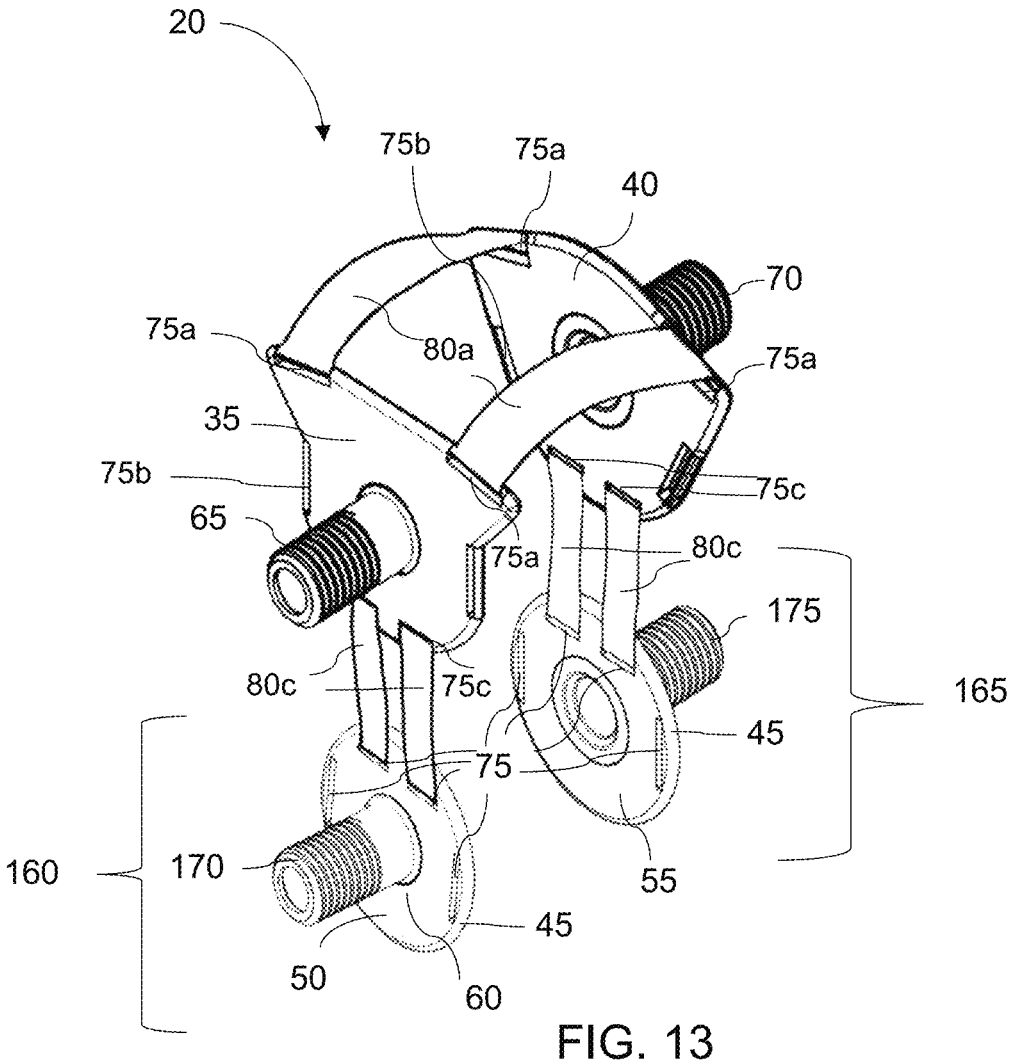
FIG. 13 is a front perspective view of a vest assembly, according to an exemplary embodiment.

In a variant, depicted in FIG. 13, the vest assembly 20 includes a second front plate 160 placed lower than the front plate 35, and a second rear plate 165 placed lower than the rear plate 40. Both the second front plate 160 and the second rear plate 165 have a central area 60, a front face 50, and a rear face 55, similar to those of the front plate 35 and the rear plate 40. The rear face 55 of the second front plate 160 faces the front side 26 of the body 25 of the user 30, while the rear face 55 of the second rear plate 165 faces the rear side (not shown) of the body 25 of the user 30. A third bolt 170 is attached to the central area 60 of the second front plate 160, and extends outward from the front face 50 of the second front plate 160. A fourth bolt 175 is attached to the central area 60 of the second rear plate 165, and extends outward from the front face 50 of the second rear plate 165. Both the second front plate 160 and the second rear plate 165 have a perimeter 45 and a plurality of slits 75 along the perimeter 45, similar to those of the front plate 35 and the rear plate 40. The plurality of slits 75 for both the front plate 35 and the rear plate 40 includes a pair of top slits 75*a*, a pair of side slits 75*b*, and a pair of bottom slits 75*c* (also detailed in FIGS. 5A and 5D). A pair of upper straps 80*a* connect the front plate 35 to the rear plate 40 between both pairs of top slits 75*a* and are each worn over a respective shoulder 85 of the user 30. A front pair of hanging straps 80*c* connect a portion of the slits 75 of the second front plate 160 to the pair of bottom slits 75*c* of the front plate 35, and hang downward along the front side 26 of the body 25 of the user 30. Likewise, a rear pair of hanging straps 80*c* connect a portion of the slits 75 of the second rear plate 165 to the pair of bottom slits 75*c* of the rear plate 40, and hang downward along the rear side of the body 25 of the user 30.

Figure 14:
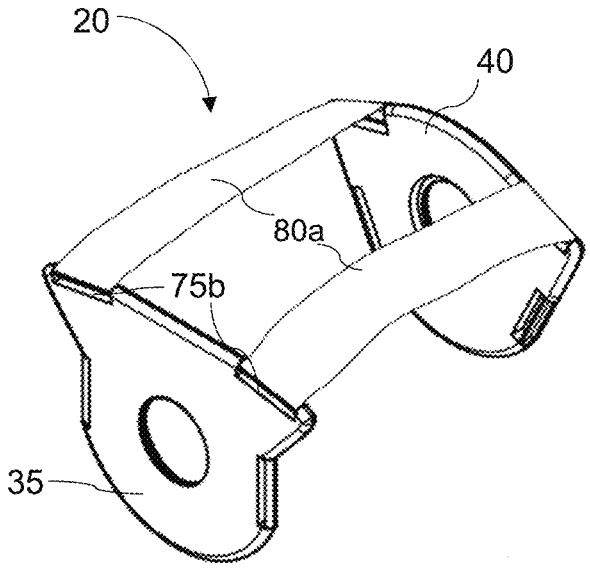
FIG. 14 is a front perspective view of a vest assembly, according to an exemplary embodiment.

In another variant, illustrated in FIG. 14, the vest assembly 20 includes only a pair of upper straps 80*a* to connect the front plate 35 to the rear plate 40 via the top slits 75*a*.

Figure 15:
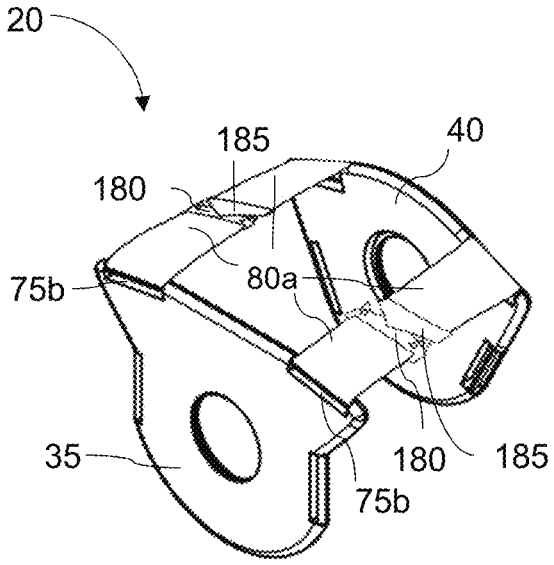
FIG. 15 is a front perspective view of a vest assembly, according to an exemplary embodiment.
Figure 16A:
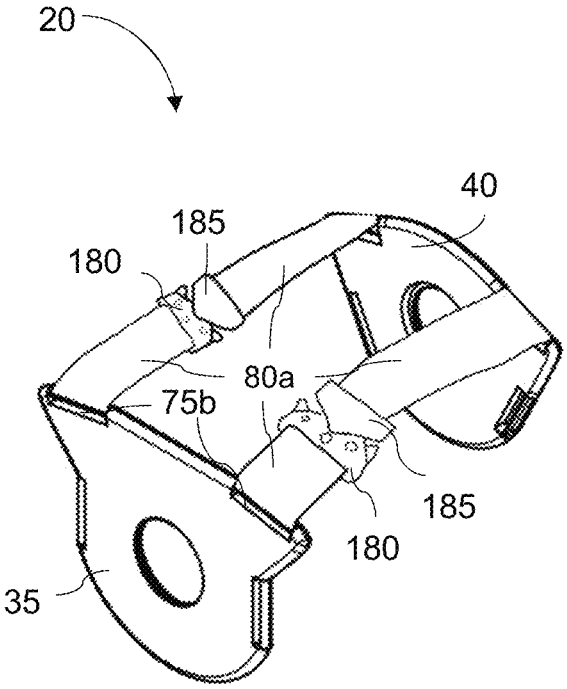
FIG. 16A is a front perspective view of a vest assembly, according to an exemplary embodiment.
Figure 16B:
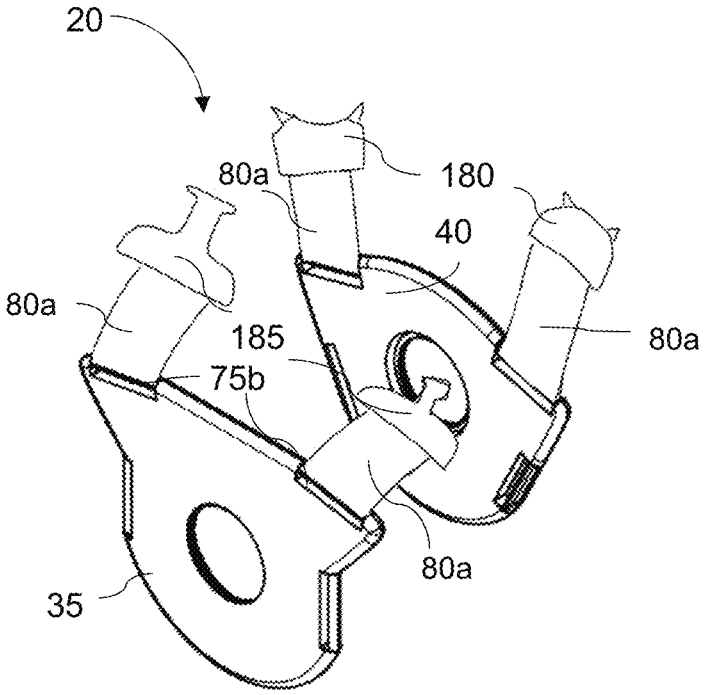
FIG. 16B is a front perspective view of a vest assembly, according to an exemplary embodiment.

In a further variant of the vest assembly 20, detailed in FIGS. 15 and 16A-16B, the front plate 35 and the rear plate 40 each include a pair of upper straps 80*a* inserted into the top slits 75*a*. As illustrated in FIGS. 15 and 16A, the upper straps 80*a* of the front plate 35 each have a female clasp 180 to connect to a male clasp 185 of the upper straps 80*a* of the rear plate 40. Conversely, as illustrated in FIG. 16B, the female clasp 180 can be attached to the upper straps 80*a* of the rear plate 40, and the male clasp 185 attached to the upper straps 80*a* of the front plate 35.

Figure 17:
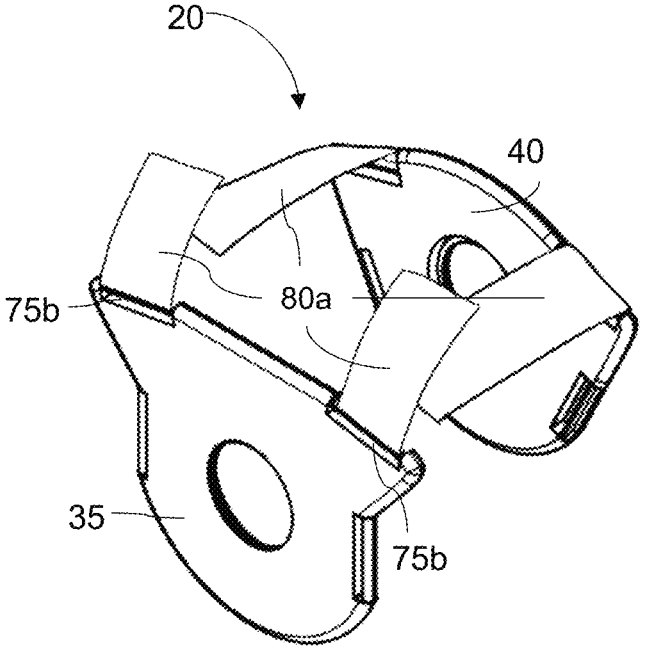
FIG. 17 is a front perspective view of a vest assembly, according to an exemplary embodiment.
Figure 18:
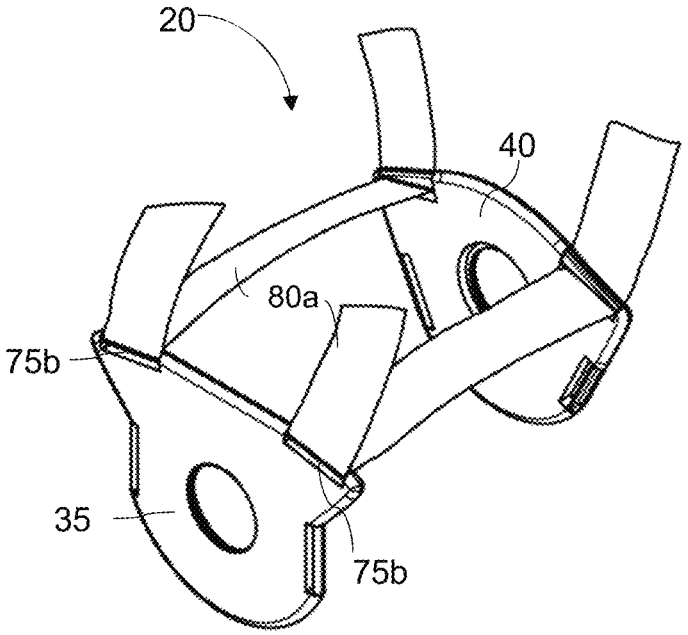
FIG. 18 is a front perspective view of a vest assembly, according to an exemplary embodiment.
Figure 19:
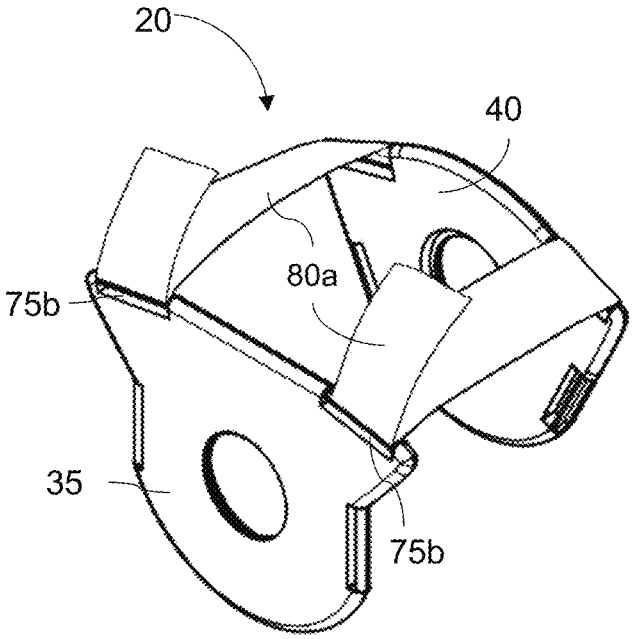
FIG. 19 is a front perspective view of a vest assembly, according to an exemplary embodiment.

In yet another variant, detailed in FIGS. 17-19, the vest assembly 20 includes only upper straps 80*a* to connect the front plate 35 to the rear plate 40 via the top slits 75*a*. The upper straps 80*a* include at least one strip of Velcro® (not shown). The upper straps 80*a* are secured by folding over the strip of Velcro®. As indicated in FIG. 17, the upper straps 80*a* of both the front plate 35 and the rear plate 40 each have a strip of Velcro®. As indicated in FIG. 18, with a single pair of upper straps 80*a* connecting the front plate 35 to the rear plate 40, each upper strap 80*a* has two strips of Velcro®. Alternatively, in FIG. 19, the vest assembly 20 has a single pair of upper straps 80*a*, with each having a single strip of Velcro®.

Figure 20:
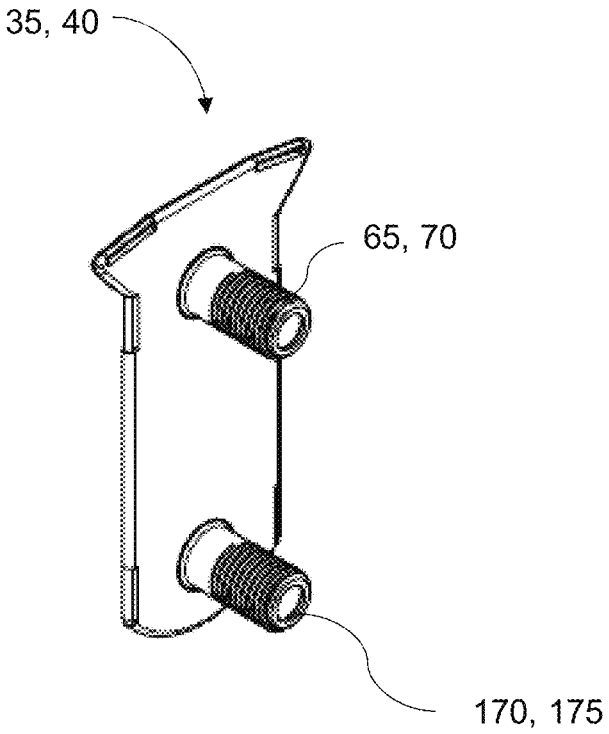
FIG. 20 is a front perspective view of a plate of a vest assembly, according to an exemplary embodiment.

In an embodiment, depicted in FIG. 20, the front plate 35 and the rear plate 40 each have two bolts. The front plate 35 has a first bolt 65 and a third bolt 170, while the rear plate 40 has a second bolt 70 and a fourth bolt 175.

What is claimed is:

1. A vest assembly, for wearing around a body of a user performing physical activity, the vest assembly comprising:

a plurality of straps;

a flat front plate and a flat rear plate, each having a perimeter, a front face, a rear face, and a central area;

a first bolt attached to the central area of the flat front plate, extending outward from the front face of the flat front plate;

a second bolt attached to the central area of the flat rear plate, extending outward from the front face of the flat rear plate;

the rear face of the flat front plate configured to face a front side of the body of the user, and the rear face of the flat rear plate configured to face a rear side of the body of the user; and the perimeter of the flat front plate comprising a plurality of slits, and the perimeter of the flat rear plate comprising a corresponding plurality of slits, such that the plurality of straps are inserted into the plurality of slits in both the flat front plate and the flat rear plate;

wherein a slit of the plurality of slits of the flat front plate tensions one of the straps together with a corresponding slit of the corresponding plurality of slits of the flat rear plate for a comfortable fit of the vest assembly around a body of the user.

2. The vest assembly of claim 1, wherein the first bolt and the second bolt are fixed respectively to the flat front plate and the flat rear plate.

3. The vest assembly of claim 1, wherein the first bolt and the second bolt are respectively removable from the flat front plate and the flat rear plate.

4. The vest assembly of claim 3, wherein the flat front plate and the flat rear plate each have a central hole;

wherein the first bolt is disposed in the central hole of the flat front plate, and the second bolt is disposed in the central hole of the flat rear plate.

5. The vest assembly of claim 3, further comprising an attachment secured to the first bolt, the attachment comprising a face having a plurality of partitions for attaching to a piece of equipment.

6. The vest assembly of claim 1, further comprising a plurality of pads attached to the plurality of straps.

7. The vest assembly of claim 1, wherein the plurality of straps comprises an upper pair of straps and a lower pair of straps.

8. The vest assembly of claim 7, wherein each of the upper pair of straps is configured to be tensioned around a shoulder of the user.

9. The vest assembly of claim 7, wherein the lower pair of straps is configured to be tensioned around a waist of the user.

10. The vest assembly of claim 1, wherein the first bolt and the second bolt each comprise a plurality of threads for mating with a nut having a corresponding plurality of threads.

11. The vest assembly of claim 1, wherein the first bolt and the second bolt are smooth.

12. The vest assembly of claim 1, wherein:

the plurality of slits of the flat front plate and the corresponding plurality of slits of the flat rear plate each comprises a pair of top slits and a pair of bottom slits;

the plurality of straps comprises a pair of upper straps inserted into both pairs of top slits to connect the flat front plate to the flat rear plate, with each upper strap configured to be worn over a respective shoulder of the user;

a second front plate located lower than the flat front plate, and a second rear plate located lower than the flat rear plate;

both the second front plate and the second rear plate include a central area, a front face, and a rear face;

the rear face of the second front plate is configured to face the front side of the body of the user, and the rear face of the second rear plate is configured to face the rear side of the body of the user;

a third bolt attached to the central area of the second front plate and extending outward from the front face of the second front plate, and a fourth holt attached to the central area of the second rear plate and extending outward from the front face of the second rear plate;

both the second front plate and the second rear plate further include a perimeter;

an additional plurality of slits along both the perimeter of the second front plate and the perimeter of the second rear plate, a front pair of hanging straps inserted into the pair of bottom slits of the flat front plate and a portion of the additional plurality of slits of the second front plate, to connect the second front plate to the flat front plate; and a rear pair of hanging straps inserted into the pair of bottom slits of the flat rear plate and a portion of the additional plurality of slits of the second rear plate, to connect the second rear plate to the flat rear plate;

wherein the front pair and rear pair hanging straps are adapted to hang downward along the front side of the body of the user, and downward along the rear side of the body of the user, respectively.

13. The vest assembly of claim 1, wherein both the flat front plate and the flat rear plate flare out in an upward direction.

14. A vest assembly, for wearing around a body of a user performing physical activity, the vest assembly comprising:

a plurality of straps comprising an upper pair of straps and a lower pair of straps; wherein the upper pair of straps are configured to tension around a pair of shoulders of the user, and the lower pair of straps are configured to tension around a torso of the user;

a plurality of pads attached to the plurality of straps; a flat front plate and a flat rear plate, each having a perimeter, a front face, a rear face, and a central area;

a first bolt fixed to the central area of the flat front plate, extending outward from the front face of the flat front plate; a second bolt fixed to the central area of the flat rear plate, extending outward from the front face of the flat rear plate;

the rear face of the flat front plate facing a front side of the body of the user, and the rear face of the flat rear plate facing a rear side of the body of the user;

and the perimeter of the flat front plate comprising a plurality of slits, and the perimeter of the flat rear plate comprising a corresponding plurality of slits, for insertion of the plurality of straps;

wherein attachment of a strap of the plurality of straps to a slit of the plurality of slits of the flat front plate and attachment of the strap with a corresponding slit of the corresponding plurality of slits of the flat rear plate tensions the strap to fit the vest assembly around a body of the user;

wherein at least one ring is connected along a length of each lower strap between the flat front plate and the flat rear plate, such that a portion of the length of each lower strap connects between the flat front plate and the at least one ring, and between the flat rear plate and the at least one ring.

15. The vest assembly of claim 14, further comprising an attachment secured to the first bolt, the attachment comprising a face having a plurality of partitions for attaching to a piece of equipment.

16. The vest assembly of claim 14, wherein each plurality of slits of the flat front plate and the flat rear plate comprises a pair of top slits and a pair of bottom slits.

17. The vest assembly of claim 16, wherein the top slits are horizontally oriented and the bottom slits are vertically oriented.

18. A vest assembly, for wearing around a body of a user performing physical activity, the vest assembly comprising:

a plurality of straps comprising an upper pair of straps and a lower pair of straps;

wherein the upper pair of straps are configured to tension around a pair of shoulders of the user, and the lower pair of straps are configured to tension around a torso of the user;

a plurality of pads attached to the plurality of straps;

a flat front plate and a flat rear plate, each having a perimeter, a front face, a rear face, a central area, and a central hole;

a first bolt removably attached to the central hole of the flat front plate, extending outward from the front face of the flat front plate;

a second holt removably attached to the central hole of the flat rear plate, extending outward from the front face of the flat rear plate; the rear face of the flat front plate facing a front side of the body of the user, and the rear face of the flat rear plate facing a rear side of the body of the user;

the perimeter of the flat front plate comprising a plurality of slits, and the perimeter of the flat rear plate comprising a corresponding plurality of slits, for insertion of the plurality of straps;

wherein a slit of the plurality of slits of the flat front plate is configured to tension one of the straps together with a corresponding slit of the corresponding plurality of slits of the flat rear plate to fit the vest assembly around a body of the user.

19. The vest assembly of claim 18, further comprising an attachment secured to the first bolt, the attachment comprising a face having a plurality of partitions for attaching to a piece of equipment.

20. The vest assembly of claim 18, wherein the plurality of pads is contiguous and is configured to conform with both the rear face of the flat front plate and the rear face of the flat rear plate.

21. The vest assembly of claim 18, further comprising at least one loop along a length of each lower strap between the flat front plate and the flat rear plate, such that a portion of the length of each lower strap connects between the flat front plate and the at least one loop; and another portion of the length of each lower strap connects between the flat rear plate and the at least one loop.

* * * * *